US011289048B2

(12) United States Patent
Koo et al.

(10) Patent No.: US 11,289,048 B2
(45) **Date of Patent: *Mar. 29, 2022**

(54) FRAME REFRESH SYNCHRONIZATION WITH SYNCHRONIZATION BOUNDARY

(71) Applicant: ATI Technologies ULC, Markham (CA)

(72) Inventors: Anthony W L Koo, Markham (CA); Aric Cyr, Mkarham (CA); Syed Athar Hussain, Markham (CA)

(73) Assignee: ATI TECHNOLOGIES ULC, Markham (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/123,359

(22) Filed: Dec. 16, 2020

(65) Prior Publication Data

US 2021/0104206 A1 Apr. 8, 2021

Related U.S. Application Data

(63) Continuation of application No. 15/993,314, filed on May 30, 2018, now Pat. No. 10,891,915.

(51) Int. Cl.

| | |
|---|---|
| ***G09G 5/00*** | (2006.01) |
| ***G09G 5/36*** | (2006.01) |
| ***G09G 5/10*** | (2006.01) |

(52) U.S. Cl.

CPC ..... *G09G 5/006* (2013.01); *G09G 5/10* (2013.01); *G09G 5/363* (2013.01); *G09G 2310/04* (2013.01); *G09G 2310/08* (2013.01); *G09G 2320/0247* (2013.01); *G09G 2320/045* (2013.01); *G09G 2320/103* (2013.01); *G09G 2360/18* (2013.01)

(58) Field of Classification Search

CPC ..... G09G 5/006; G09G 5/10; G09G 5/363; G09G 5/395; G09G 2310/04; G09G 2310/08; G09G 2320/045; G09G 2320/103; G09G 2320/0247; G09G 2340/0435; G09G 2360/18

See application file for complete search history.

(56) References Cited

U.S. PATENT DOCUMENTS

| | | | | |
|---|---|---|---|---|
| 8,334,857 | B1 * | 12/2012 | Ogrinc | G09G 5/377 345/204 |
| 10,891,915 | B2 * | 1/2021 | Koo | G09G 5/363 |
| 2006/0146056 | A1 * | 7/2006 | Wyatt | G09G 5/006 345/501 |

(Continued)

FOREIGN PATENT DOCUMENTS

| | | | | |
|---|---|---|---|---|
| KR | 10 1609948 | B1 * | 4/2016 | H04N 21/4402 |

*Primary Examiner* — Antonio A Caschera
*Assistant Examiner* — Donna J. Ricks

(57) ABSTRACT

A GPU is generally configured to detect changes in the rate of frame generation that can result from, for example, changes in the complexity of the frames being generated. In response to detecting the change in the rate of frame generation, the GPU identifies a corresponding change in the refresh rate that would be required to fully synchronize the refresh rate with the rate of frame generation. If the change in the refresh rate falls outside the boundaries of a specified or dynamically generated window, the GPU limits the change in refresh rate to the corresponding boundary.

20 Claims, 4 Drawing Sheets

(56) References Cited

U.S. PATENT DOCUMENTS

| | | | | |
|---|---|---|---|---|
| 2015/0348509 | A1* | 12/2015 | Verbeure | G06T 1/20 345/213 |
| 2017/0053620 | A1* | 2/2017 | Law | G06T 1/20 |
| 2018/0040285 | A1* | 2/2018 | Sakurai | G09G 3/3648 |
| 2018/0174551 | A1* | 6/2018 | Ansari | G09G 5/12 |

* cited by examiner

FRAME REFRESH SYNCHRONIZATION WITH SYNCHRONIZATION BOUNDARY

CROSS-REFERENCE TO RELATED APPLICATIONS

The present application is a continuation application of U.S. patent application Ser. No. 15/993,314, entitled "FRAME REFRESH SYNCHRONIZATION WITH SYNCHRONIZATION BOUNDARY", and filed on May 30, 2018, the entirety of which is incorporated by reference herein.

BACKGROUND

Description of the Related Art

A typical processing system employs a graphics processing unit (GPU) to generate images for display. In particular, based on information received from a central processing unit (CPU) or other processing unit, the GPU generates a series of frames and renders the series of frames at a display, such as a computer monitor. Two different timing factors govern the rate at which the series of frames can be displayed: the rate at which the GPU generates frames and the refresh rate of the display. Some processing systems improve the user experience by synchronizing the display refresh with the generation of frames at the GPU. For example, by adjusting the blanking interval of the display, the processing system can ensure that the display is refreshed at or near the time that a new frame is ready for display at the GPU. However, conventional synchronization techniques can cause flickering and other visual artifacts that negatively impact the user experience.

BRIEF DESCRIPTION OF THE DRAWINGS

The present disclosure may be better understood, and its numerous features and advantages made apparent to those skilled in the art by referencing the accompanying drawings. The use of the same reference symbols in different drawings indicates similar or identical items.

DETAILED DESCRIPTION

FIGS. 1-6 illustrate techniques for synchronizing the refresh rate of a display with a frame generation rate of a graphics processing unit (GPU) while reducing the likelihood of flicker and other visual artifacts resulting from the synchronization. The GPU is generally configured to detect changes in the rate of frame generation that can result from, for example, changes in the complexity of the frames being generated. In response to detecting the change in the rate of frame generation, the GPU identifies a corresponding change in the refresh rate that would be required to fully synchronize the refresh rate with the rate of frame generation. If the change in the refresh rate falls outside the boundaries of a specified or dynamically generated window, the GPU limits the change in refresh rate to the corresponding boundary. The GPU thus prevents large changes (or "jumps") in the refresh rate in a short amount of time, thereby reducing the likelihood of flicker and other visual artifacts resulting from the synchronization.

Figure 1:
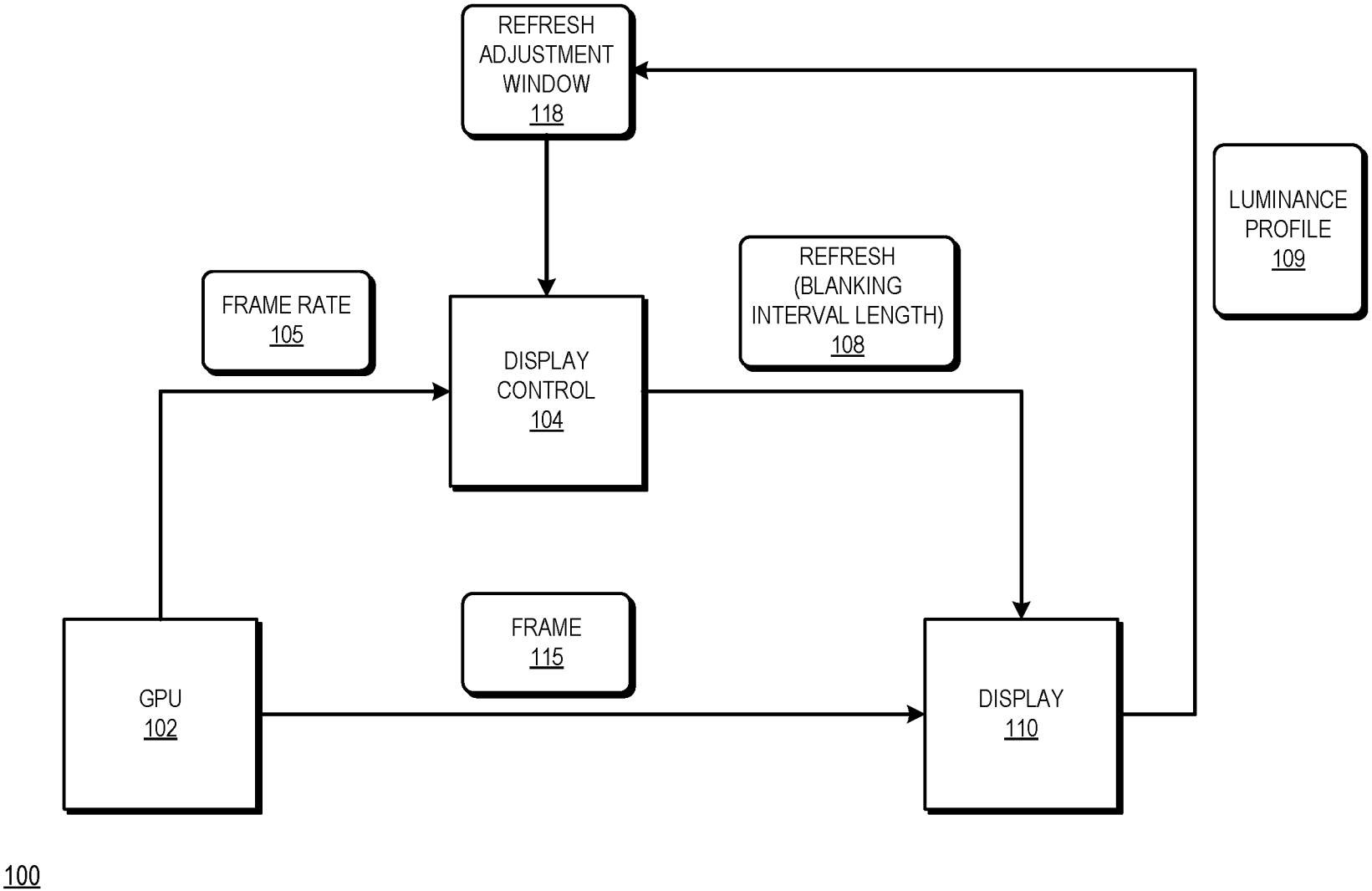
FIG. 1 is a block diagram of a processing system configured to limit the adjustment of a refresh rate at a display to within a boundary window in response to changes in a frame generation rate at a graphics processing unit in accordance with some embodiments.

FIG. 1 illustrates a processing system 100 configured to limit the adjustment of a refresh rate at a display to within a boundary window in response to changes in a frame generation rate at a graphics processing unit in accordance with some embodiments.

The processing system 100 is generally configured to execute sets of instructions (e.g., computer programs) to carry out specified tasks for an electronic device. Examples of such tasks include controlling aspects of the operation of the electronic device, displaying information to a user to provide a specified user experience, communicating with other electronic devices, and the like. Accordingly, in different embodiments the processing system 100 is employed in one of a number of types of electronic device, such as a desktop computer, laptop computer, server, game console, tablet, smartphone, and the like.

To support execution of the sets of instructions, the processing system 100 includes a plurality of processor cores (not shown at FIG. 1). In some embodiments, each processor core includes one or more instruction pipelines to fetch instructions, decode the instructions into corresponding operations, dispatch the operations to one or more execution units, execute the operations, and retire the operations. In the course of executing instructions, the processor cores generate graphics operations and other operations associated with the visual display of information. Based on these operations, the processor cores provide commands and data to a graphics processing unit (GPU) 102, illustrated at FIG. 1.

The GPU 102 is generally configured to receive the commands and data associated with graphics and other display operations from the plurality of processor cores. Based on the received commands, the GPU 102 executes operations to generate frames (e.g., frame 115) for display. Examples of operations include vector operations, drawing operations, and the like. The rate at which the GPU 102 is able to generate based on these operations is referred to as the frame generation rate, or simply the frame rate, of the GPU 102. The frame generation rate is illustrated at FIG. 1 as frame rate 105. It will be appreciated that the frame rate 105 varies over time, based in part on the complexity of the operations executed by the GPU to generate a set of frames. For example, sets of frames requiring a relatively high number of operations (as a result of drawing a relatively large number of moving objects for example) are likely to cause a lower frame rate, while sets of frames requiring a relatively low number of operations are likely to allow for a higher frame rate.

To display frames, the processing system 100 includes a display control module 104 and a display 110. The display 110 is a display device generally configured to visually display images based on the frames generated by the GPU 102. Accordingly, in different embodiments the display 110 is a liquid crystal display (LCD) device, an organic light-emitting diode (OLED) device, and the like. As will be appreciated by one skilled in the art, the display 110 is generally configured to periodically render (or "draw") the most recent frame generated by the GPU 102, thereby displaying the frame. Each frame render is associated with a portion of time, referred to as a blanking interval, during which the display 110 does not render image data. The display 110 is configured to have a blanking interval of programmable length. Accordingly, as described further herein, the refresh rate 108 of the display 110 is adjustable by programming different lengths for the blanking interval.

The display control module 104 is generally configured to control the rendering of frames at the display 110. Accordingly, in some embodiments the display control module 104 performs operations including buffering of frames generated by the GPU 102, adjustment of the refresh rate 108 of the display 110 by programming different blanking interval lengths, and the like. It will be appreciated that although the display control module 104 is illustrated as a separate module from the GPU 102 for ease of illustration, in some embodiments the display control module 104 is incorporated in the GPU 102. In other embodiments, one or more operations of the display control module 104 are performed at the display 110.

In some embodiments, the display control module 104 manages synchronization of the frame rate 105 with the refresh rate 108. By synchronizing the two rates so that they match within a specified threshold margin, the display control module 104 ensures that frames generated by the GPU 102 are displayed relatively quickly at the display 110, thereby supporting smoother display of moving objects, reduced likelihood of visual artifacts, and otherwise improving the user experience with the processing system 100.

To synchronize the generation of frames at the GPU 102 with the display of those frames, the display control module 104 monitors the frame rate 105. In some embodiments, the frame rate 105 represents a moving average of the rate at which the GPU 102 generates frames over a specified number of frames, such as over the previous N generated frames, where N is an integer. In response to a change in the frame rate 105, the display control module 104 adjusts the refresh rate 108 over time until the refresh rate 108 and the frame rate 105 match within a specified margin of error. In some embodiments, the display control module 104 adjusts the refresh rate 108 by programming different values for the blanking interval of the display 110.

As noted above, large adjustments to the refresh rate 108 can cause flickering or other visual artifacts at the display 110. To ameliorate the likelihood of such visual artifacts, the display control module 104 limits the incremental adjustment of the refresh rate 108. To illustrate, in response to identifying that the refresh rate 108 is to be adjusted based on a change in the frame rate 105, the display control module 104 determines the amount of adjustment needed to synchronize the frame rate 105 and the refresh rate 108. For purposes of description, this amount of adjustment is referred to as the full adjustment. The display control module 104 compares the full adjustment to a threshold, wherein the threshold corresponds to an adjustment that is predicted to be unlikely to result in flickering or other visual artifacts at the display 110. In response to identifying that the full adjustment is less than the threshold, the display control module 104 adjusts the refresh rate 108 by the full adjustment. In response to identifying the full adjustment exceeds the threshold, the display control module 104 adjusts the refresh rate over a number of rendered frames in specified increments corresponding, for example, to the threshold. Thus, for example, if the threshold is 1 millisecond (ms), indicating than an adjustment in the refresh rate 108 by more than 1 ms is likely to cause flicker, and the full adjustment is 3 ms, the display control module 104 adjusts the refresh rate by 1 ms each for the next three frames. The display control module 104 thereby reduces the likelihood that changes in the refresh rate 108 will result in visual artifacts, while maintaining relatively frequent synchronization between the refresh rate 108 and the frame rate 105.

In some embodiments, both positive and negative adjustments in the refresh rate 108 of greater than the threshold amount result in visual artifacts. Accordingly, in some embodiments, the display control module 104 stores the threshold as a refresh adjustment window 118 that indicates a range of adjustments, such as plus or minus 1 ms. In response to a change in the frame rate 105, the display control module 104 compares the corresponding full adjustment to boundaries of the refresh adjustment window 118. If the full adjustment would not result in an adjustment outside the boundaries of the refresh adjustment window 118. If not, the display control module 104 adjusts the refresh rate 108 by the full adjustment. If the full adjustment would result in an adjustment outside the boundaries of the refresh adjustment window 118, the display control module 104 incrementally adjust the refresh rate 108 over a plurality of frames as described above.

In some embodiments, the display control module 104 sets the size of the refresh adjustment window 118 based on a luminance profile 109 of the display 110. The luminance profile 109 reflects luminance characteristics of the display 110, and in particular reflects a sensitivity of the display 110 to changes in the refresh rate 108. Thus, for a display having a luminance profile 109 indicating relatively high sensitivity to changes in the refresh rate 108, the display control module 104 sets the size of the refresh adjustment window 118 to be relatively small. For a display having a luminance profile 109 indicating relatively low sensitivity to changes in the refresh rate 108, the display control module 104 sets the size of the refresh window to be relatively large. In some embodiments, the luminance profile 109 varies over time based on aging of the display 110, different operating conditions of the processing system 100, different types of graphics being displayed via the frames generated by the GPU 102 and the like. Accordingly, in some embodiments the display control module 104 periodically detects changes in the luminance profile 109 and based on the detected changes adjusts the size of the refresh adjustment window 118. The processing system 100 thereby continues to suppress flickering and other artifacts that could result from relatively large changes in the refresh rate 108 even as the luminance profile 109 changes.

Examples of the processing system 100 adjusting the refresh rate 108 are illustrated at FIGS. 2-5 in accordance with some embodiments. Each of FIGS. 2-5 illustrate two sets of intervals, with the top set in each Figure representing intervals during which a frame is rendered at the GPU 102 and the middle set in each Figure representing corresponding intervals during which a frame is drawn at the display 110. The bottom set of intervals illustrate the refresh adjustment window 118 in accordance with some embodiments. In the illustrated examples, the refresh adjustment window 118 has a size of 2 ms and therefore represents an adjustment of plus or minus 1 ms. That is, in the illustrated examples, the refresh adjustment window 118 sets a maximum incremental adjustment of the refresh rate 108 as plus or minus 1 ms.

Figure 2:
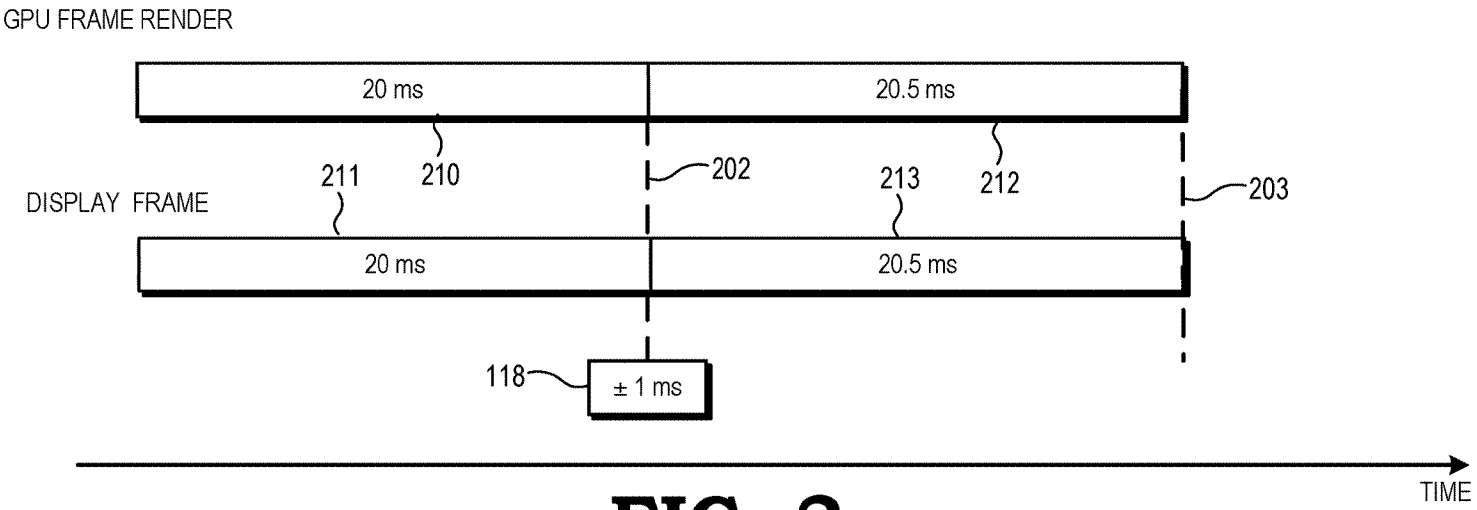
FIG. 2 is a diagram illustrating an example of the processing system of FIG. 1 limiting the adjustment of a refresh rate at a display to within a boundary window in response to changes in a frame generation rate in accordance with some embodiments.

FIG. 2 illustrates an example of adjusting the refresh rate 108 when the full adjustment falls within the refresh adjustment window 118 in accordance with some embodiments. In the illustrated example, the GPU 102 initially renders a frame during an interval 210, wherein the interval 210 is 20 ms in length. Thus, the frame rate 105 in the example of FIG. 2 is initially 20 ms. Further, in the example of FIG. 2 the refresh rate 108 is initially synchronized with the frame rate 105 at 20 ms, as illustrated by interval 211.

At a time 202, the display control module 104 detects an increase in the frame rate 105 of 0.5 ms, resulting in a frame rate of 20.5 ms as illustrated by interval 212. In response to the change in the frame rate 105, the display control module 104 determines that the corresponding full adjustment to the refresh rate 108 (that is, the total amount of adjustment to maintain synchronization between the frame rate 105 and the refresh rate 108) is 0.5 ms. The display control module 104 further identifies that the full adjustment is within the boundaries of the refresh adjustment window 118. Accordingly, the display control module 104 adjusts the refresh rate 108 by the full adjustment of 0.5 ms to 20.5 ms, as illustrated by interval 213. Thus, in the depicted example the GPU 102 completes rendering a frame between time 202 and a time 203, and the display 110 draws a frame between the same two time periods, thus maintaining synchronization of frame drawing and frame display.

Figure 3:
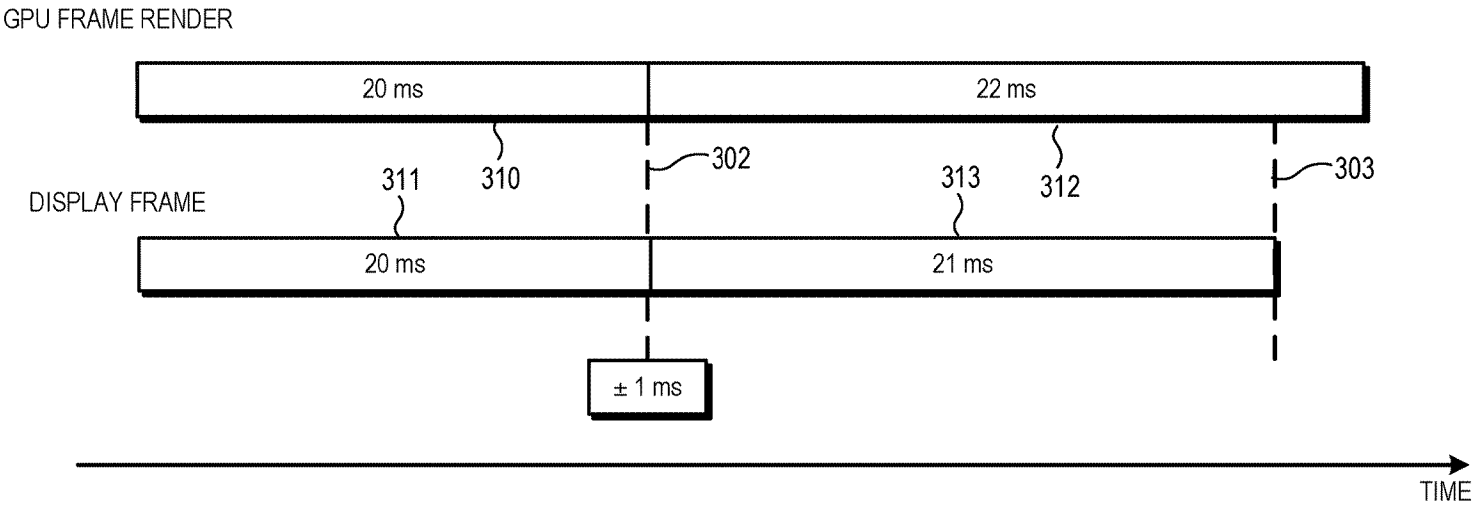
FIG. 3 is a diagram of another example of the processing system of FIG. 1 limiting the adjustment of a refresh rate at a display to within a boundary window in response to changes in a frame generation rate in accordance with some embodiments.

FIG. 3 illustrates an example of adjusting the refresh rate 108 when the full adjustment is greater than the upper boundary of the refresh adjustment window 118 in accordance with some embodiments. In the illustrated example, similar to FIG. 2, the GPU 102 initially renders a frame during an interval 310, wherein the interval 310 is 20 ms in length. Thus, the frame rate 105 in the example of FIG. 3 is initially 20 ms. Further, in the example of FIG. 3 the refresh rate 108 is initially synchronized with the frame rate 105 at 20 ms, as illustrated by interval 311.

At a time 302, the display control module 104 detects an increase in the frame rate 105 of 2 ms, resulting in a frame rate of 22 ms as illustrated by interval 312. In response to the change in the frame rate 105, the display control module 104 determines that the corresponding full adjustment to the refresh rate 108 is 2 ms. The display control module 104 further identifies that the full adjustment is greater than the upper boundary of the refresh adjustment window 118. Accordingly, the display control module 104 adjusts the refresh rate 108 by an adjustment corresponding to the upper boundary of plus 1 ms, resulting in a refresh rate of 21 ms as illustrated by interval 313. Thus, in the depicted example the display 110 draws a frame between the time 302 and a time 303, while the GPU initiates rendering of a frame at time 302 but does not complete rendering the frame until after time 303. The frame rate 105 and the refresh rate 108 are therefore at least temporarily unsynchronized. In some embodiments, such as illustrated below with respect to FIG. 5, the display control module 104 continues to iteratively adjust the refresh rate 108 until the frame rate 105 and the refresh rate 108 are synchronized.

Figure 4:
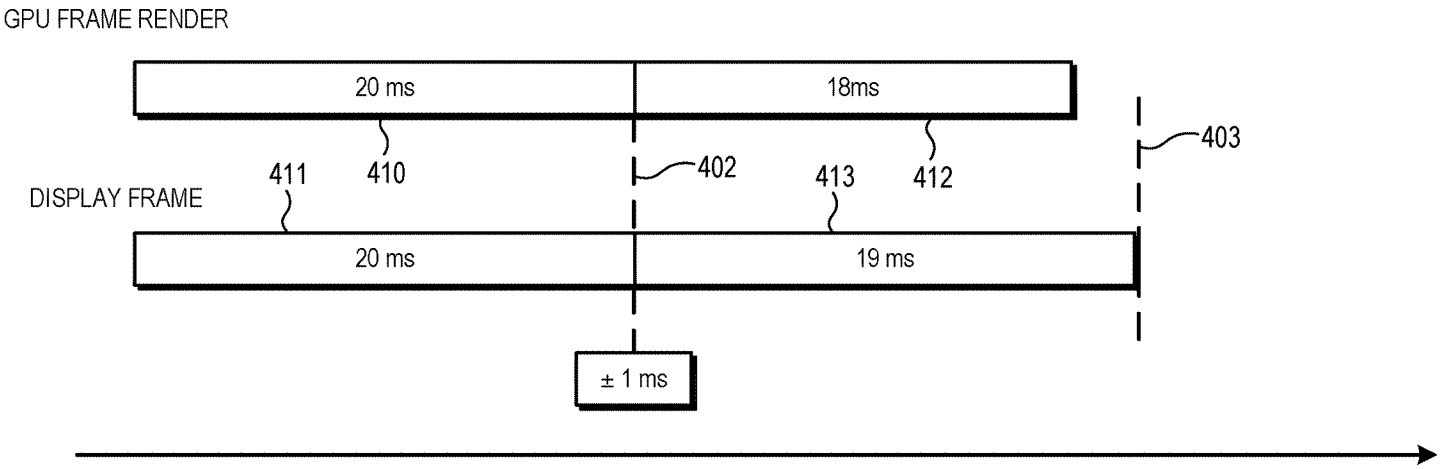
FIG. 4 is a diagram of yet another example of the processing system of FIG. 1 limiting the adjustment of a refresh rate at a display to within a boundary window in response to changes in a frame generation rate in accordance with some embodiments.

FIG. 4 illustrates an example of adjusting the refresh rate 108 when the full adjustment is lower than the lower boundary of the refresh adjustment window 118 in accordance with some embodiments. In the illustrated example, similar to FIGS. 2 and 3, the GPU 102 initially renders a frame during an interval 410 that is 20 ms in length. Thus, the frame rate 105 in the example of FIG. 4 is initially 20 ms. Further, in the example of FIG. 4 the refresh rate 108 is initially synchronized with the frame rate 105 at 20 ms, as illustrated by interval 411.

At a time 402, the display control module 104 detects a decrease in the frame rate 105 of 2 ms, resulting in a frame rate of 18 ms as illustrated by interval 412. In response to the change in the frame rate 105, the display control module 104 determines that the corresponding full adjustment to the refresh rate 108 is −2 ms. The display control module 104 further identifies that the full adjustment is lower than the lower boundary of the refresh adjustment window 118. Accordingly, the display control module 104 adjusts the refresh rate 108 by an adjustment corresponding to the lower boundary of −1 ms, resulting in a refresh rate of 19 ms as illustrated by interval 413. Thus, in the depicted example the display 110 draws a frame between the time 402 and a time 403, while the GPU initiates rendering of a frame at time 302 and completes rendering the frame prior to time 403, such that the frame rate 105 and the refresh rate 108 are at least temporarily unsynchronized. In some embodiments, such as illustrated below with respect to FIG. 5, the display control module 104 continues to iteratively adjust the refresh rate 108 until the frame rate 105 and the refresh rate 108 are synchronized.

Figure 5:
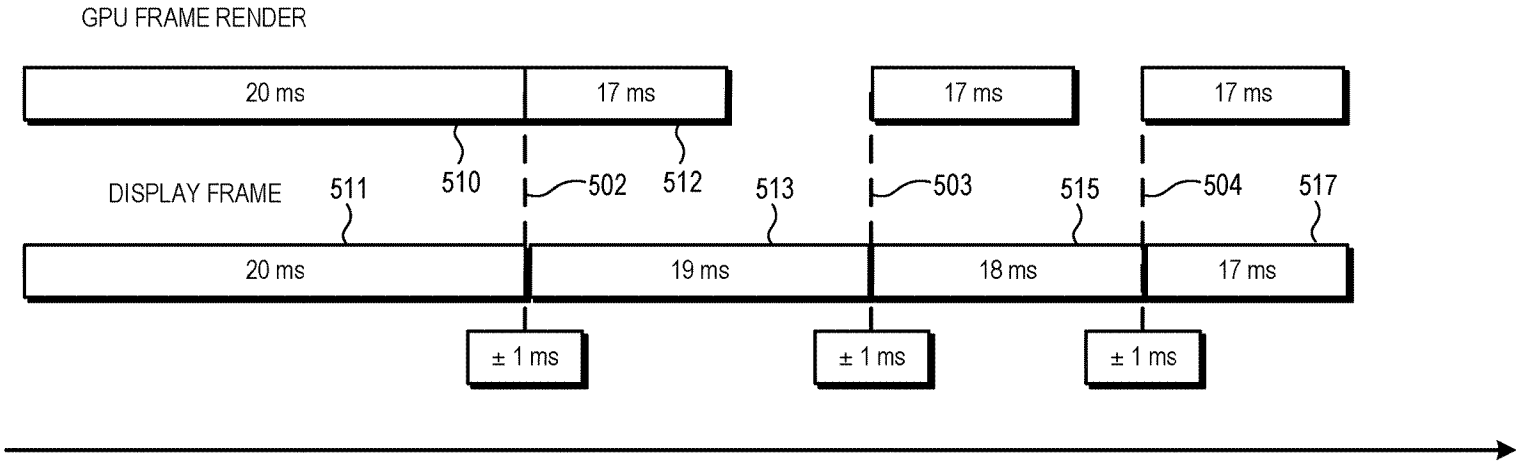
FIG. 5 is a diagram of still another example of the processing system of FIG. 1 limiting the adjustment of a refresh rate at a display to within a boundary window in response to changes in a frame generation rate in accordance with some embodiments.

FIG. 5 illustrates an example of the display control module 104 iteratively adjusting the refresh rate 108 when the full adjustment is lower than the lower boundary of the refresh adjustment window 118 in accordance with some embodiments. In the illustrated example, similar to FIGS. 2-4, the GPU 102 initially renders a frame during an interval 510 that is 20 ms in length. Thus, the frame rate 105 in the example of FIG. 5 is initially 20 ms. Further, in the example of FIG. 5 the refresh rate 108 is initially synchronized with the frame rate 105 at 20 ms, as illustrated by interval 511.

At a time 502, the display control module 104 detects a decrease in the frame rate 105 of 3 ms, resulting in a frame rate of 17 ms as illustrated by interval 512. In response to the change in the frame rate 105, the display control module 104 determines that the corresponding full adjustment to the refresh rate 108 is −3 ms. The display control module 104 further identifies that the full adjustment is lower than the lower boundary of the refresh adjustment window 118. Accordingly, the display control module 104 adjusts the refresh rate 108 by an adjustment corresponding to the lower boundary of −1 ms, resulting in a refresh rate of 19 ms as illustrated by interval 513.

At or around the completion of the interval 513 at time 503, the display control module 104 identifies that the frame rate 105 remains at 17 ms, and therefore again adjusts the refresh rate 108 by −1 ms, resulting in a refresh rate of 18 ms as illustrated by interval 515. Finally, at or around the completion of the interval 515 at time 501, the display control module 104 once again identifies that the frame rate 105 remains at 17 ms, and therefore once again adjusts the refresh rate 108 by −1 ms, resulting in a refresh rate of 17 ms as illustrated by interval 517. Thus, in the example of FIG. 5, the display control module 104 adjusts the refresh rate 108 by incremental adjustments of 1 ms until the frame rate 105 and the refresh rate 108 are synchronized. In contrast, a conventional processing system adjusts the refresh rate by the full adjustment immediately, resulting in the display of visual artifacts that negatively impact the viewer experience.

Figure 6:
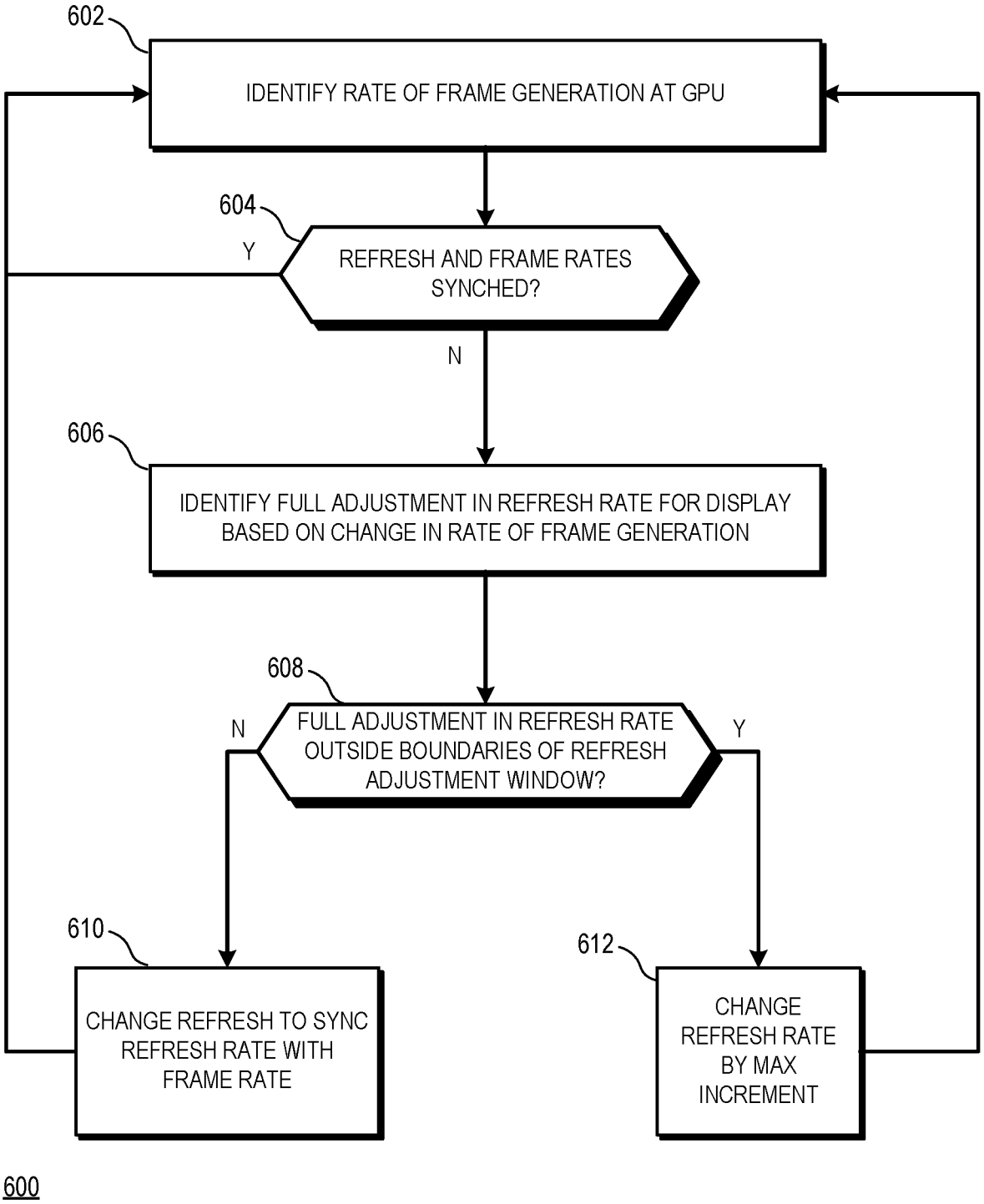
FIG. 6 is a flow diagram of a method of a graphics processing unit limiting the adjustment of a refresh rate at a display to within a boundary window in response to changes in a frame generation rate in accordance with some embodiments.

FIG. 6 is a flow diagram of a method 600 of a graphics processing unit limiting the adjustment of a refresh rate at a display to within a boundary window in response to changes in a frame generation rate in accordance with some embodiments. At block 602, the GPU identifies the rate of frame generation (the frame rate). That is, the GPU determines the rate at which the GPU is generating frames available to be displayed. At block 604, the GPU identifies whether the refresh rate of a display and the frame rate are synchronized. If so, the method returns to block 602 and the GPU waits for the next frame to again identify the frame rate.

If, at block 604, the GPU identifies that the refresh rate and the frame rate are different, the method flow moves to block 606 and the GPU identifies the full adjustment to the refresh rate that is required to synchronize the refresh rate with the frame rate of the GPU. At block 608, the GPU identifies whether the full adjustment falls outside the boundaries of a refresh adjustment window. If not, the method flow proceeds to block 610 and the GPU changes the refresh rate of the display by the full adjustment, thereby synchronizing the frame rate of the GPU and the refresh rate of the display. The method flow returns to block 602.

Returning to block 608, if the GPU identifies that the full adjustment falls outside the boundaries of the refresh adjustment window, the method flow moves to block 612 and the GPU changes the refresh rate by a maximum increment, corresponding to one of the boundaries of the refresh adjustment window. The method flow returns to block 602 and the GPU waits for the next frame to once again identify the current frame rate. If the frame rate and the refresh rate remain unsynchronized over several frames, the GPU continues to iteratively adjust the refresh rate over the several frames until the refresh rate and the frame rate are synchronized.

In some embodiments, certain aspects of the techniques described above may implemented by one or more processors of a processing system executing software. The software comprises one or more sets of executable instructions stored or otherwise tangibly embodied on a non-transitory computer readable storage medium. The software can include the instructions and certain data that, when executed by the one or more processors, manipulate the one or more processors to perform one or more aspects of the techniques described above. The non-transitory computer readable storage medium can include, for example, a magnetic or optical disk storage device, solid state storage devices such as Flash memory, a cache, random access memory (RAM) or other non-volatile memory device or devices, and the like. The executable instructions stored on the non-transitory computer readable storage medium may be in source code, assembly language code, object code, or other instruction format that is interpreted or otherwise executable by one or more processors.

A computer readable storage medium may include any non-transitory storage medium, or combination of non-transitory storage media, accessible by a computer system during use to provide instructions and/or data to the computer system. Such storage media can include, but is not limited to, optical media (e.g., compact disc (CD), digital versatile disc (DVD), Blu-Ray disc), magnetic media (e.g., floppy disc, magnetic tape, or magnetic hard drive), volatile memory (e.g., random access memory (RAM) or cache), non-volatile memory (e.g., read-only memory (ROM) or Flash memory), or microelectromechanical systems (MEMS)-based storage media. The computer readable storage medium may be embedded in the computing system (e.g., system RAM or ROM), fixedly attached to the computing system (e.g., a magnetic hard drive), removably attached to the computing system (e.g., an optical disc or Universal Serial Bus (USB)-based Flash memory), or coupled to the computer system via a wired or wireless network (e.g., network accessible storage (NAS)).

Note that not all of the activities or elements described above in the general description are required, that a portion of a specific activity or device may not be required, and that one or more further activities may be performed, or elements included, in addition to those described. Still further, the order in which activities are listed are not necessarily the order in which they are performed. Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims. Moreover, the particular embodiments disclosed above are illustrative only, as the disclosed subject matter may be modified and practiced in different but equivalent manners apparent to those skilled in the art having the benefit of the teachings herein. No limitations are intended to the details of construction or design herein shown, other than as described in the claims below. It is therefore evident that the particular embodiments disclosed above may be altered or modified and all such variations are considered within the scope of the disclosed subject matter. Accordingly, the protection sought herein is as set forth in the claims below.

What is claimed is:

1. A processor, comprising:

a display control module configured to:

in response to a change in a frame generation rate of a graphics processing unit (GPU), generate a synchronization adjustment specifying an amount of adjustment to synchronize the frame generation rate with a refresh rate of a display; and in response to the synchronization adjustment exceeding a threshold amount, adjust the refresh rate of the display by increments less than or equal to the threshold amount until the synchronization adjustment is achieved.

2. The processor of claim 1, wherein the threshold is based on a luminance characteristic of the display.

3. The processor of claim 2, wherein the display control module is further configured to:

detect a change in the luminance characteristic of the display; and adjust the threshold based on the change in the luminance characteristic of the display.

4. The processor of claim 2, wherein the display is configured to have a blanking interval of programmable length.

5. The processor of claim 4, wherein the display control module is further configured to:

adjust the refresh rate of the display by adjusting the length of the blanking interval.

6. The processor of claim 2, wherein the display control module is further configured to:

adjust the threshold based on changes in an average frame generation rate associated with the graphics processing unit.

7. A non-transitory computer readable storage medium embodying a set of executable instructions, the set of executable instructions to manipulate at least one processor to:

in response to a first change in a frame generation rate of a graphics processing unit (GPU), generate a first synchronization adjustment specifying an amount of adjustment to synchronize the frame generation rate with a refresh rate of a display;

in response the first synchronization adjustment exceeding a first boundary, set the first synchronization adjustment to a first level; and adjust the refresh rate of the display based on the first synchronization adjustment.

8. The non-transitory computer readable storage medium of claim 7, wherein the set of executable instructions is to manipulate the processor to:

identify the first boundary by applying an offset to a current refresh rate of the display.

9. The non-transitory computer readable storage medium of claim 7, wherein the set of executable instructions is to manipulate the processor to:

in response to the first synchronization adjustment exceeding a second boundary, set the first synchronization adjustment to a second level.

10. The non-transitory computer readable storage medium of claim 9, wherein the first boundary corresponds to a negative offset from a current refresh rate of the display and the second boundary corresponds to a positive offset from a current refresh rate of the display.

11. The non-transitory computer readable storage medium of claim 7, wherein the first boundary is based on a luminance characteristic of the display; and wherein the set of executable instructions is to manipulate the processor to:

detect a change in the luminance characteristic of the display; and adjust the first boundary based on the change in the luminance characteristic of the display.

12. The non-transitory computer readable storage medium of claim 7, wherein the set of executable instructions is to manipulate the processor to:

in response to a second change in the frame generation rate, generate a second synchronization adjustment;

in response to the second synchronization adjustment exceeding the first boundary, set the second synchronization adjustment to the first level; and adjust the refresh rate of a display based on the second synchronization adjustment.

13. The non-transitory computer readable storage medium of claim 7, wherein the first boundary is based on an average frame generation rate associated with the graphics processing unit.

14. The non-transitory computer readable storage medium of claim 13, wherein the set of executable instructions is to manipulate the processor to:

adjust the first boundary based on changes in the average frame generation rate associated with the graphics processing unit.

15. A method, comprising:

in response to a change in a frame generation rate of a graphics processing unit (GPU), generating a first synchronization adjustment specifying an amount of adjustment to synchronize the frame generation rate with a refresh rate of a display;

in response to the first synchronization adjustment being within an adjustment window, adjusting a refresh rate of the display by the first synchronization adjustment over a single rendered frame; and in response to the first synchronization adjustment being outside of the adjustment window, adjusting a refresh rate of the display by less than the first synchronization adjustment over multiple rendered frames.

16. The method of claim 15, further comprising:

identifying a first boundary of the adjustment window by applying an offset to a current refresh rate of the display.

17. The method of claim 16, further comprising:

detecting a change in a luminance characteristic of the display; and adjusting the first boundary based on the change in the luminance characteristic of the display.

18. The method of claim 16, further comprising:

in response to a second change in the frame generation rate, generating a second synchronization adjustment;

in response to the second synchronization adjustment exceeding the first boundary, setting the second synchronization adjustment to the first boundary; and adjusting the refresh rate of a display based on the second synchronization adjustment.

19. The method of claim 16, further comprising:

in response to the first synchronization adjustment exceeding a second boundary of the adjustment window, limiting the first synchronization adjustment to a second level.

20. The method of claim 19, wherein the first boundary corresponds to a negative offset from a current refresh rate of the display and the second boundary corresponds to a positive offset from a current refresh rate of the display.

* * * * *